US009206783B2

(12) United States Patent
Sano

(10) Patent No.: US 9,206,783 B2
(45) Date of Patent: Dec. 8, 2015

(54) IGNITION COIL FOR INTERNAL COMBUSTION ENGINE

(71) Applicant: DENSO CORPORATION, Kariya, Aichi-pref. (JP)

(72) Inventor: Masafuyu Sano, Okazaki (JP)

(73) Assignee: DENSO CORPORATION, Kariya (JP)

( * ) Notice: Subject to any disclaimer, the term of this patent is extended or adjusted under 35 U.S.C. 154(b) by 272 days.

(21) Appl. No.: 14/055,196

(22) Filed: Oct. 16, 2013

(65) Prior Publication Data

US 2014/0102430 A1 Apr. 17, 2014

(30) Foreign Application Priority Data

Oct. 17, 2012 (JP) ..... 2012-230023

(51) Int. Cl.

| | |
|---|---|
| ***H01F 38/00*** | (2006.01) |
| ***F02P 1/08*** | (2006.01) |
| ***F02P 3/02*** | (2006.01) |
| ***H01T 13/44*** | (2006.01) |
| *H01F 38/12* | (2006.01) |

(52) U.S. Cl.

CPC . *F02P 1/083* (2013.01); *F02P 3/02* (2013.01); *H01T 13/44* (2013.01); *H01F 38/12* (2013.01)

(58) Field of Classification Search

CPC ..... F02P 1/083; F02P 3/02; H01T 13/44; H01T 13/02; H01T 13/04; H01F 38/12

USPC ..... 123/605, 634, 635, 647; 361/263

See application file for complete search history.

(56) References Cited

U.S. PATENT DOCUMENTS

| | | | | |
|---|---|---|---|---|
| 5,109,209 | A * | 4/1992 | Ida | H01F 38/12 264/272.19 |
| 5,225,801 | A * | 7/1993 | Ida | H01F 5/04 336/107 |
| 5,295,861 | A * | 3/1994 | Peretick | H01F 38/12 123/647 |
| 5,936,501 | A * | 8/1999 | Seino | F16D 27/112 335/142 |
| 6,178,957 | B1 * | 1/2001 | Widiger | F02P 3/02 123/634 |
| 2005/0122196 | A1 * | 6/2005 | Fujiyama | H01F 38/12 336/90 |
| 2006/0021608 | A1 * | 2/2006 | Takeyama | F02P 3/02 123/634 |
| 2014/0345582 | A1 * | 11/2014 | Yamauchi | H01F 38/12 123/634 |

FOREIGN PATENT DOCUMENTS

| | | |
|---|---|---|
| JP | 04-005622 | 1/1992 |
| JP | 2001-160428 | 6/2001 |
| JP | 3410988 | 3/2003 |
| JP | 2003-124043 | 4/2003 |

* cited by examiner

*Primary Examiner* — Hai Huynh
*Assistant Examiner* — Gonzalo Laguarda
(74) *Attorney, Agent, or Firm* — Nixon & Vanderhye PC

(57) ABSTRACT

An ignition coil for an internal combustion engine is equipped with an assembly of a connector casing and a coil body. The coil body includes a primary winding wound around a primary spool. The connector casing has terminals each of which is equipped with a conductor fastener. The conductor fastener has a slit in which one of ends of the primary winding is fit to make an electric connection between the terminal and the primary winding. The primary spool has conductor guides and a backup support to establish alignment of each of the ends of the primary winding with one of the conductor fasteners and also to facilitate insertion of each of the ends of the primary winding into one of the conductor fasteners when the coil body is fitted into the connector casing, thereby ensuring the stability of electric connection between the primary winding and the terminal.

6 Claims, 7 Drawing Sheets

IGNITION COIL FOR INTERNAL COMBUSTION ENGINE

CROSS REFERENCE TO RELATED DOCUMENT

The present application claims the benefit of priority of Japanese Patent Application No. 2012-230023 filed on Oct. 17, 2012, the disclosure of which is totally incorporated herein by reference.

BACKGROUND ART

1 Technical Field

This disclosure relates generally to an ignition coil for use in producing an electric spark in a spark plug for use in internal combustion engines.

2 Background Art

Typical ignition coils for use in internal combustion engines are equipped with a primary coil and a secondary coil. The primary coil is made up of a primary spool and a primary winding wound around the primary spool. Similarly, the secondary coil is made up of a secondary spool and a secondary winding wound around the secondary spool. The primary coil and the secondary coil are disposed coaxially as a coil assembly within a casing. The coil assembly is fit at an end thereof in a hole of a connector casing in which an igniter is installed.

After the primary winding is wound around the outer periphery of the primary spool, ends of the primary winding are coupled to terminals mounted on the primary spool The terminals of the primary spool are resistance-welded to terminals of the connector casing.

Japanese Patent First Publication No. 2003-124043 discloses an ignition coil which has a primary coil. The primary coil includes a primary winding wound around a primary spool. The primary winding has leading and trailing ends retained by winding holders provided in flanges of the primary spool. The retaining of the leading and trailing ends of the primary winding in the winding holders is achieved by fitting terminals on the winding holders. The terminals are disposed directly on a connector, thereby eliminating the need for intermediate terminals in the primary spool.

The ignition coil of the above publication, however, has the leading and trailing ends of the primary winding extending outside the end of the primary spool in the lengthwise direction of the primary spool, thus resulting in an increased overall length of the primary coil. The misalignment of the leading and trailing ends of the primary winding from the terminals when the terminals are put on the winding holders may result in a failure in making contacts between the terminals and the winding holders, which leads to an excess of load on the terminals and deformation thereof. This may result in bad electric connections between the terminals and the primary winding.

The primary winding is coated with an electric insulation. The structure of the above publication may result in a failure in stripping the electric insulation from the primary winding when the terminals are put on the leading and trailing ends of the primary winding.

SUMMARY

It is therefore an object to provide an improved structure of an ignition coil for an internal combustion engine which is designed to extend an end of a primary winding outside a primary coil in a radius direction of the primary coil to minimize the size of the ignition coil and also to facilitate making an electric connection between the primary winding and a terminal.

According to one aspect of an embodiment, there is provided an ignition coil for use with an internal combustion engine. The ignition coil comprises a coil body and a connector casing. The coil body has a base end and a top end farther away from the base end and includes a coil casing, a primary coil, and a secondary coil. The primary coil and the secondary coil are disposed coaxially with each other within the coil casing. The primary coil includes a primary spool which is made of resin and around which a primary winding is wound. The primary winding has a winding end which extends from the primary spool substantially in a winding direction that is a direction in which the primary winding is wound. The connector casing includes a fitting hole in which the base end of the coil body is fit and a connector for energizing the primary coil. The connector also includes a conductive terminal which extends from the fitting hole to the connector and has a conductor fastener disposed inside the fitting hole. The conductor fastener has formed therein a gripping slit which extends in a direction in which the coil body is fitted into the connector casing. The primary spool is equipped with a backup support which protrudes toward the connector casing in a fitting direction that is a direction in which the based end of the coil body is fitted into the connector casing. The backup support works to physically support the winding end. The connector casing also includes conductor guides which extend toward the primary spool in the fitting direction and are disposed away from each other across the conductor fastener in the winding direction. Each of the conductor guides has a guide slit into which the winding end is inserted. The guide slit includes a main guide slot and a tapered opening. The main guide slot has side wall extending substantially parallel to each other. The tapered opening leads to the main guide slot and has a width tapering away from the coil body in the fitting direction. Each of the conductor guides is so shaped that the winding end is inserted into the guide slit before it is thrust into the gripping slit of the conductor fastener when the coil body is fitted into the connector casing.

The connector casing is, as described above, designed to have installed therein the terminal which is shaped to have the conductor fastener in which the winding end of the primary winding is retained. The winding end of the primary winding extends from the primary spool substantially in the winding direction in which the primary winding is wound, thereby avoiding an undesirable increase in length of the primary spool. This permits the size of the ignition coil to be reduced.

The connector casing also has the conductor guides. Each of the conductor guides has the guide slit into which the winding end is inserted before being fitted into the gripping slit of the conductor fastener, thereby establishing the alignment of the winding end with the gripping slit of the conductor fastener.

The primary spool is, as described above, equipped with the backup support which protrudes toward the connector casing in the fitting direction. The backup support works to physically support the winding end when the coil body is fitted into the connector casing, thereby facilitating accurate insertion of the winding end into the gripping slit of the conductor fastener.

In the preferred mode, the conductor fastener is made up of two side plates which face each other and a top plate which connects ends of the side plates which are closer to the coil body. The gripping slit extends continuously through the top plate into the side plates.

The guide slit of each of the conductor guides has a width greater than that of the gripping slit of the conductor fastener.

The gripping slit includes narrow slots which extend substantially parallel to each other and tapered openings each of which leads to one of the narrow slots. Each of the tapered openings has a width widening toward the coil body.

The backup support may have formed in a surface thereof a recess which supports the winding end in contact therewith.

Each of the conductor guides serves to establish alignment of the winding end with the gripping slit of the conductor fastener when the winding end is thrust into the gripping slit and then gripped in the conductor fastener to make an electric connection of the winding end and the conductive terminal.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings:

FIG. 6(*b*) is a partial perspective view which illustrates a winding end of a primary winding which has been inserted into guide slits of conductor guides, but not yet fitted into a conductor fastener completely;

DESCRIPTION OF THE PREFERRED EMBODIMENTS

Figure 1:
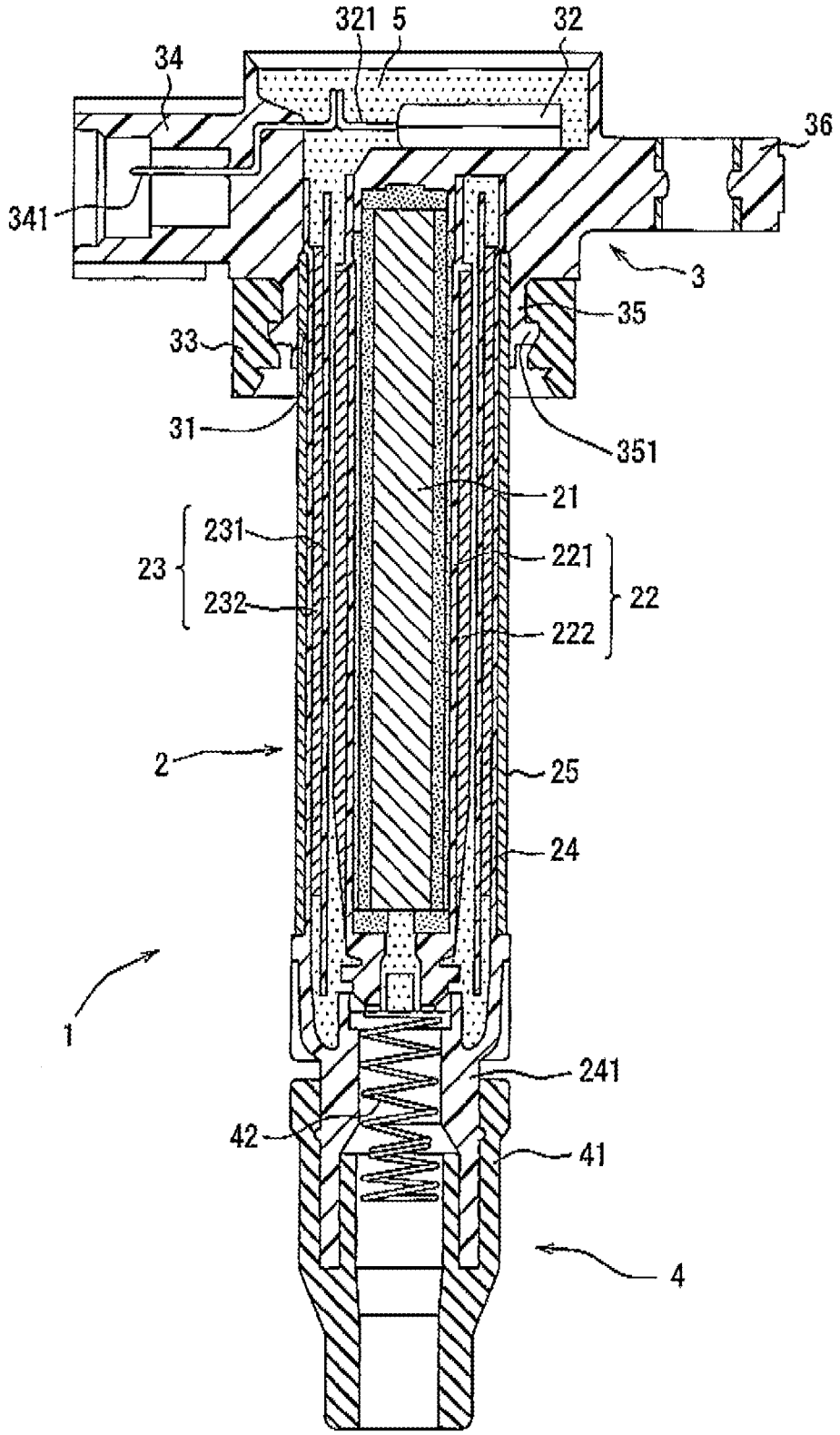
FIG. 1 is a longitudinal sectional view which illustrates an ignition coil of an embodiment.

Referring to the drawings, wherein like reference numbers refer to like parts in several views, particularly to FIG. 1, there is shown an ignition coil 1 for use with a spark plug (not shown) installed in an internal combustion engine. The ignition coil 1 includes a hollow cylindrical coil body 2 and a connector casing 3. The coil body 2 forms a body of the ignition coil 1 and has a head facing a combustion chamber (not shown) of the internal combustion engine. A plug cap 41 is put on the head of the coil body 2. A coil seal rubber 33 is wrapped around a portion of the connector casing 3 joined to a portion of the coil body 2 which is farther away from the head thereof in order to avoid ingress of water into a plug hole of the internal combustion engine. In the following discussion, an end or a portion of the ignition coil 1 closer to the combustion chamber of the internal combustion engine (i.e., the spark plug) will be referred to as a top end or a top portion (also called a first end or a first portion), while an end or a portion of the ignition coil 1 farther away from the combustion chamber will be referred to as a base end or a base portion (also called a second end or a second portion).

The connector casing 3 is formed in the shape of a box and made from a thermoplastic resin such as polybutylene terephthalate (PBT) or polyphenylene sulfide (PPS). The connector casing 3 includes a fitting hole 31 opening to the top end of the ignition coil 1, a connector 34, and a mounting flange 36. The connector 34 is equipped with connector pins (i.e., terminals) 341 for electrical connections to an external device. The mounting flange 36 has a hole into which a fastening member such as a bolt is inserted to attach the ignition coil 1 to the internal combustion engine.

The connector casing 3 also includes a hollow cylindrical extension 35 protruding from an inner edge thereof defining the fitting hole 31 toward the top end of the ignition coil 1 in an axial direction of the ignition coil 1. The cylindrical extension 35 has a barbed flange 351 formed on an outer periphery thereof. The barbed flange 351 extends in a radial direction of the coil body 2 to make a mechanical joint of the coil seal rubber 33 to the connector casing 3. The coil seal rubber 33 serves to avoid the ingress of water or dust into a clearance between the ignition coil 1 and the internal combustion engine when the ignition coil 1 is installed in the internal combustion engine.

The connector casing 3 also has disposed therein an igniter 32 which is equipped with a switching circuit to energize or deenergize a primary coil 23. The igniter 32 is, as can be seen from FIGS. 1 and 2, connected electrically to the connector terminals 341 and conductive terminals 6 of the connector 34 in the connector casing 3 through igniter terminals 321. The igniter 32 is joined to an external power supply and an external device through the connector terminals 341.

The connector terminals 341 include a positive power supply terminal, a negative power supply terminal, and switching terminals. Some of the connector terminals 341 are coupled electrically to the igniter 32 through the terminals 6 and also to a primary winding 232 of the primary coil 23 in the coil body 2 through the terminals 6. The igniter 32 is connected to the terminals 6 through the connector terminals 341, however, may be coupled directly to the terminals 6 through the igniter terminals 321.

The coil body 2 is equipped with a coil casing 24, a center core 21, a secondary coil 22, the primary coil 23, and an outer core 25. The center core 21 is formed in the shape of a hollow cylinder and made of a soft magnetic material. The coil casing 24 is formed in the shape of a hollow cylinder. The center core 21 is formed in the shape of a cylinder and disposed inside the coil casing 24. The secondary coil 22 is disposed outside the periphery of the center core 21 within the coil casing 24. The primary coil 23 is disposed outside the periphery of the secondary coil 22 within the coil casing 24. The outer core 25 serves as a coil shell and is wrapped about the outer periphery of the coil casing 24.

The coil casing 24 is formed in the shape of a hollow cylinder and made of thermoplastic resin. The coil casing 24 has a top portion 241 (which will also be referred to as a coil casing top below) which is smaller in outer diameter than a major part of the coil casing 24. A conductor 42 which is formed in the shape of a spring is disposed inside the coil casing top 241. The conductor 42 works to apply a high voltage, as produced by the coil body 2, to the spark plug. The plug cap 41 which is made of an insulating material is fit on the coil casing top 241 and serves as a protector to cover a portion of the coil casing top 241. The plug cap 41 defines a plug-fitting portion 4 into which the spark plug is inserted.

The plug cap 41 partially covers the coil casing top 241 and hermetically seal it to avoid the adhesion of water to the coil casing top 241. The plug cap 41 also works to avoid the leakage of high voltage, as applied to the spark plug, outside the ignition coil 1, thereby ensuring the stability in producing a sequence of sparks in the spark plug.

The primary coil 23 which is disposed inside the coil casing 24 is made up of a primary spool 231 and a primary winding 232. The primary spool 231 is formed in the shape of a hollow cylinder made of thermoplastic resin. The primary winding 232 is wound around the outer periphery of the primary spool 231. The secondary coil 22 is made up of a secondary spool 221 and a secondary winding 222. The secondary spool 221 is formed in the shape of a hollow cylinder made of thermoplastic resin. The secondary winding 222 is wound around the outer periphery of the secondary spool 221. The secondary winding 222 has a top end coupled electrically to the conductor 42 disposed inside the coil casing top 241.

Figure 3:
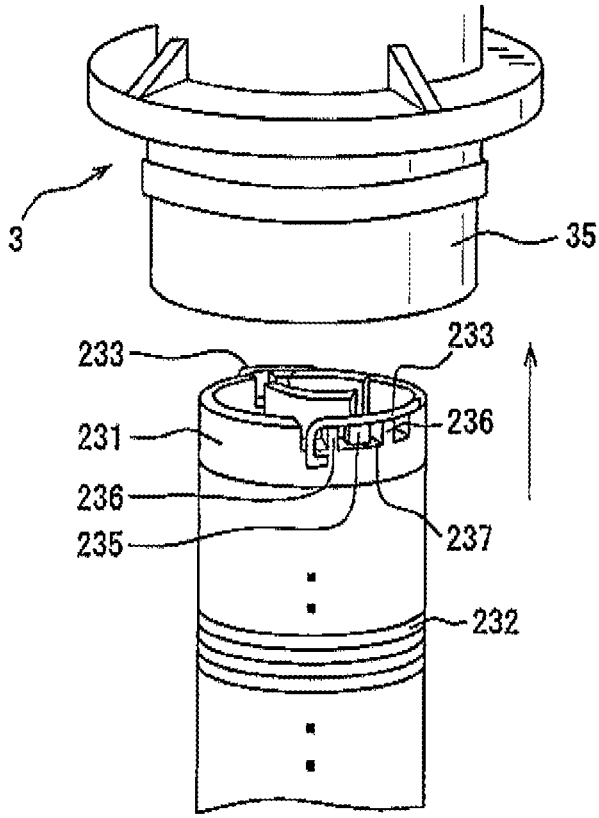
FIG. 3 is a perspective view which shows how to fit a coil body into a connector casing of the ignition coil of FIG. 1.

The primary winding 232, as clearly illustrated in FIG. 3, has base ends exposed outside an end surface of the primary spool 231 to form winding ends 233. Each of the winding ends 233 extends from the primary spool 231 substantially in a direction in which the primary winding 232 is wound around the primary spool 231. Each of the primary winding 232 and the secondary winding 222 is made of conductor wire covered with insulating coating. The conductor wire of the secondary winding 222 is smaller in diameter, but greater in number of turns than that of the primary winding 232.

Epoxy resin is filled both in the connector casing 3 and in the coil body 2 as an electric insulator to insulate among parts of the ignition coil 1 such as terminals and the igniter 32 in the connector casing 3, the primary winding 232, and the secondary winding 222 and also to ensure the stability of electric contact therebetween.

The fitting of the connector casing 3 on the coil body 2 will be described below with reference to FIGS. 2, 3, and 4.

Figure 2:
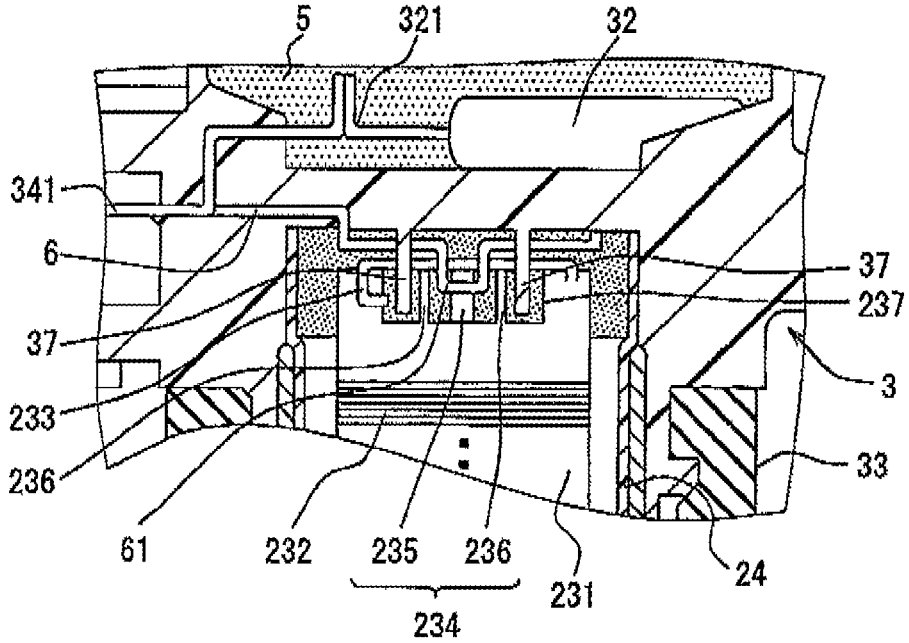
FIG. 2 is a partial sectional view which illustrates a connector casing fit on a coil body of the ignition coil of FIG. 1.

FIG. 2 is a partial sectional view which illustrates the connector casing 3 fit on the coil body 2.

The joining of the coil body 2 to the connector casing 3 is achieved by fitting the outer periphery of the base portion of the coil casing 24 tightly into the hole 31 of the connector casing 3. This establishes coaxial alignment of the center core 21, the primary coil 23, and the secondary coil 22 with the longitudinal center line of the ignition coil 1.

Each of the terminals 6 has a portion exposed outside the connector casing 3. The exposed portion of each of the terminals 6, as clearly illustrated in FIG. 4, partially overlaps the outer circumference of the primary spool 231 and has a U-shaped conductor fastener 61 which protrudes toward the top of the ignition coil 1. The conductor fastener 61 is formed by bending the exposed portion of the terminal 6 into a U-shape. The conductor fastener 61 of each of the terminals 6 has, as illustrated in FIG. 5, a gripping slit 62 which extends continuously through the longitudinal center line thereof, in other words, extends in a direction in which the coil body 2 is fitted into the connector casing 3. Each of the winding ends 233 is inserted into a corresponding one of the gripping slits 62 to make a joint of the winding end 233 and the terminal 6.

The connector casing 3 has two pairs of conductor guides 37 extending toward the top of the ignition coil 1. The conductor guides 37 of each pair are located on both sides of one of the conductor fasteners 61 in the circumferential direction of the primary spool 231 (i.e., the coil body 2), in other words, disposed at a given interval away from each other across the conductor fastener 61 in a winding direction that is a direction in which the primary winding 232 is wound around the primary spool 231. The conductor guides 37 are, like the connector casing 3, made of thermoplastic resin.

The primary spool 231 has formed in a base end surface thereof recesses 237 which define U-shaped chambers. Each of the conductor fasteners 61 which are diametrically opposed to each other is partially disposed in one of the recesses 237 when the connector casing 3 is fit on the coil body 2. The primary spool 231 also has backup supports 234 each of which is formed in one of the recesses 237. Each of the backup supports 234 extends from the bottom of one of the recesses 237 toward the connector casing 3 (i.e., the base end of the ignition coil 1) in a fitting direction that is a direction in which the coil body 2 is fitted into the connector casing 3. Each of the backup supports 234 works to support or retain the winding end 233 in contact therewith. Each of the backup supports 234 includes a first backup protrusion 235 and two second backup protrusions 236. The first backup protrusion 235 partially extends into the gripping slit 62 of the conductor fastener 61 and works as a guide to assist the insertion of the winding end 233 into the gripping slit 62 of the conductor fastener 61. The second backup protrusions 236 extends from the bottom of the recess 237 at both sides of the first backup protrusion 235. The second backup protrusions 236 work as a guide to assist the insertion of the winding end 233 into the conductor guides 37 and the conductor fastener 61. The second backup protrusions 236 are, as described above, so located as to face each other across the conductor fastener 61 in the circumferential direction of the coil body 2.

The winding ends 233 of the primary winding 232 are exposed outside the base end surface of the primary spool 231. Each of the winding ends 233 extend, as can be seen from FIG. 4, along a direction of a tangent of the periphery of the coil body 2 within a corresponding one of the recesses 237 and is retained by a corresponding one of the backup supports 234.

FIG. 3 is a perspective view which shows how to fit the coil body 2 into the connector casing 3. FIG. 4 is a schematic explanatory view which illustrates the layout of the terminals around the connector casing 3, as viewed from above the coil body 2. FIG. 3 illustrates the outer appearance of the primary coil 23 of the coil body 2 from which the coil casing 24 and the outer core 25 are omitted.

The joining of the coil body 2 and the connector casing 3 is achieved by orienting the coil body 2 so as to align each of the recesses 237 with one of the conductor fasteners 61 of the connector casing 3 and insert the base end of the coil body 2 into the connector casing 3. The two recesses 237 are, as clearly illustrated in FIG. 3, formed in the base end of the primary spool 231 axisymmetrically with respect to the longitudinal center line of the coil body 2.

Figure 4:
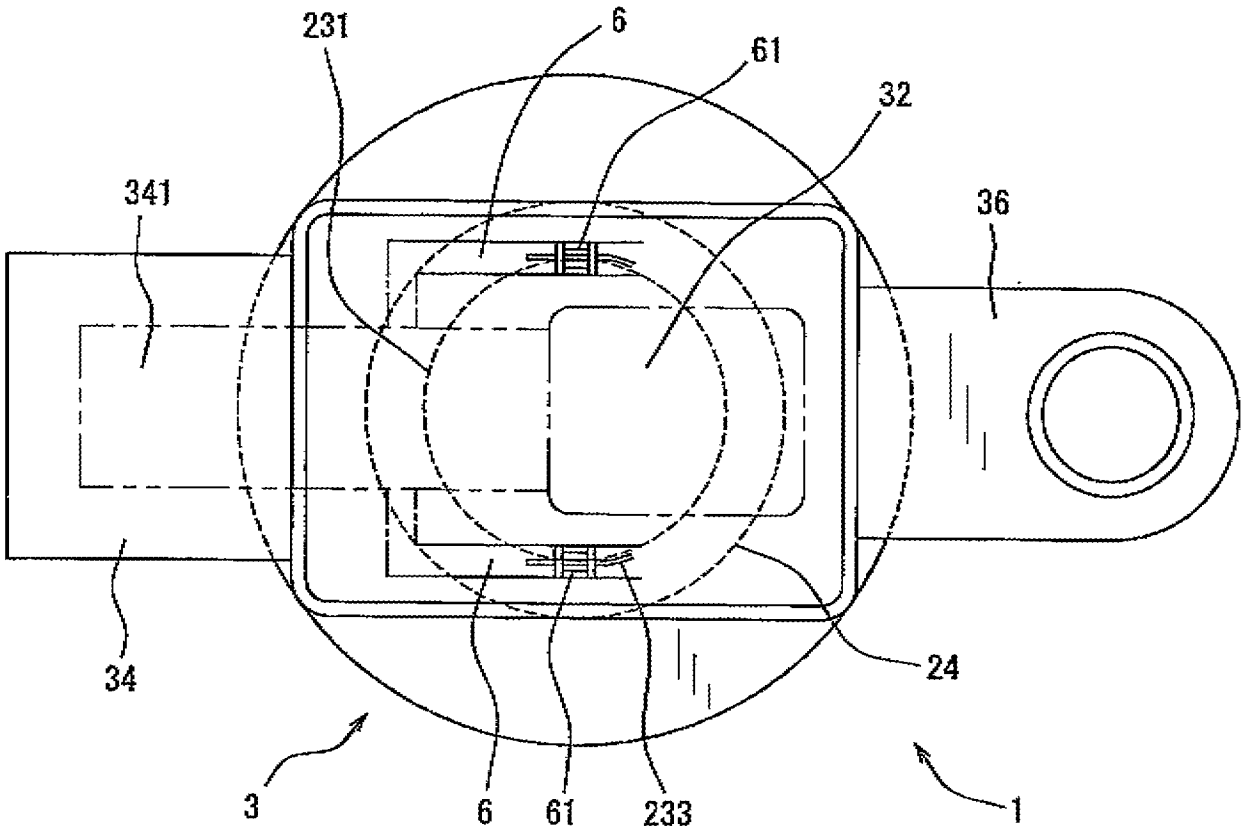
FIG. 4 is a schematic explanatory view which illustrates the layout of terminals disposed around a connector casing of the ignition coil of FIG. 1.
Figure 5:
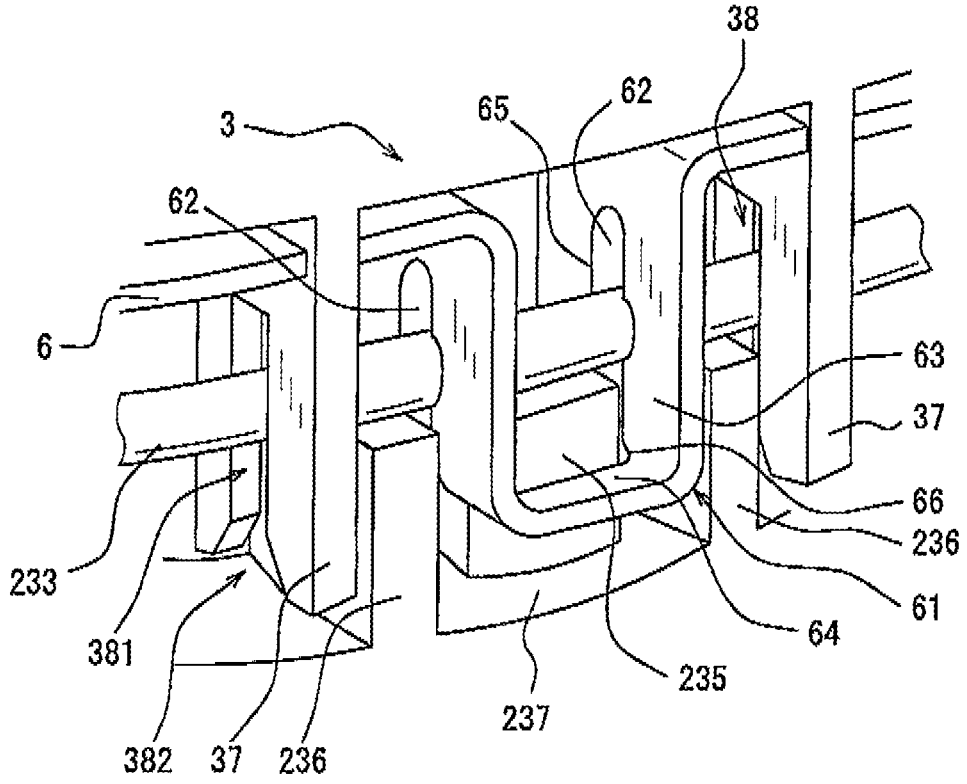
FIG. 5 is a partially enlarged perspective view which shows how to join a winding end of a primary winding to a conductor fastener of the ignition coil of FIG. 1.

The terminals 6, as illustrated in FIG. 4, extend in the direction of a tangent of the circumference of the primary spool 231 and connect with the igniter 32 and the connector terminals 341. Each of the two conductor fasteners 61 is located at a point of contact between the circumference of the primary spool 231 and a corresponding one of the terminals 6 and disposed within a corresponding one of the recesses 237.

The end surfaces of the winding ends face in the same direction in this embodiment, however, may be oriented in opposite directions.

FIG. 5 is a partially enlarged perspective view which shows how to join the winding end 233 to the conductor fastener 61.

Each of the conductor fasteners 61 is made up of two upright plates 63 (which will also be referred to as side plates) and a horizontal plate 64 (which will also be referred to as a top plate). The upright plates 63 extend in a vertical direction of the connector casing 3 (i.e., the primary spool 231) and face each other in the circumferential direction of the primary spool 231. The horizontal plate 64 extends horizontally to connect lower ends of the upright plates 63 to make the U-shaped conductor fastener 61. The lower ends of the upright plates 63 are closer to the coil body 2. The conductor fastener 61, as described above, has the gripping slit 62 which extends through the centers of the upright plates 63 and the horizontal plate 64 in the width-wise direction thereof. In other words, the gripping slit 62 extends continuously through the horizontal plate 64 into the upright plates 63. A portion of the gripping slit 62 which lies in each of the upright plates 63 is broken down into two sections: a narrow slot 65 and a tapered opening 66. The narrow slots 65 extend parallel to each other and vertically in the upright plates 63. Each of the narrow slots 65 has side surfaces extending substantially parallel to each other. In other words, the narrow slot 65 has a substantially constant width. The tapered opening 66 leads to the narrow slot 65. Lower ends (i.e., top ends) of the side surfaces of the narrow slots 65 which are closer to the primary spool 231 taper upward, as viewed in FIG. 5, that is, widen downward to define the tapered opening 66. In other words, the tapered opening 66 has a width widening away from the narrow slot 65. The tapered opening 66, clearly illustrated in FIGS. 5 and 7, has a lowermost end which is greatest in width, thereby making a portion of the gripping slit 62 extending in the horizontal plate 64 to be wider than the narrow slot 65. The width of the narrow slots 65 is slightly smaller than the diameter of the winding ends 233 so as to strip the winding ends 233 of insulating coating.

The width of a portion of the gripping slit 62 extending in the horizontal plate 64 is greater than the width of the first backup protrusion 235 in the radius direction of the coil body 2. The distance or interval between the upright plates 63 of each of the conductor fasteners 61 which face each other in the circumferential direction of the coil body 2 is greater than the length of the first backup protrusion 235 in the circumferential direction of the coil body 2. This permits the first backup protrusion 235 to pass through the portion of the gripping slit 62 in the horizontal plate 64 vertically, as viewed in FIG. 5.

Each of the conductor guides 37 has formed therein a guide slit 38 extending in the lengthwise direction thereof. The guide slit 38 is greater in width than the gripping slit 62 of the conductor fastener 61. The guide slit 38 is made up of two sections: a main guide slot 381 and a tapered opening 382. The main guide slot 381 has side surfaces extending substantially parallel to each other. In other words, the main guide slot 381 has a substantially constant width. The tapered opening 382 has a width tapering upwardly, as viewed in FIG. 5 (i.e., the fitting direction), and leads to the main guide slot 381. In other words, the tapered opening 382 widens downwardly, as viewed in FIG. 5, to form an open end of the guide slit 38 which works as an inlet for insertion of the winding end 233 into the main guide slot 381.

When the coil body 2 is fitted into the connector casing 3, each of the winding ends 233 is inserted into the conductor guides 37 and the conductor fastener 61 while being supported by the first backup protrusion 235 and the second backup protrusions 236.

The length of each of the conductor guides 37 extending in the axial direction of the coil body 2 is greater than that of the upright plates 63 of the conductor fastener 61 so that the winding end 233 may enter the guide slits 38 of the conductive wire guides 37 before being thrust into the gripping slit 62 of the conductor fastener 61. The width of the main guide slot 381 of each of the conductor guides 37 is greater than the diameter of the winding end 233.

How to insert each of the winding ends 233 into one of the conductor fasteners 61 will be described below with reference to FIGS. 6(*a*) and 6(*b*).

Figure 6A:
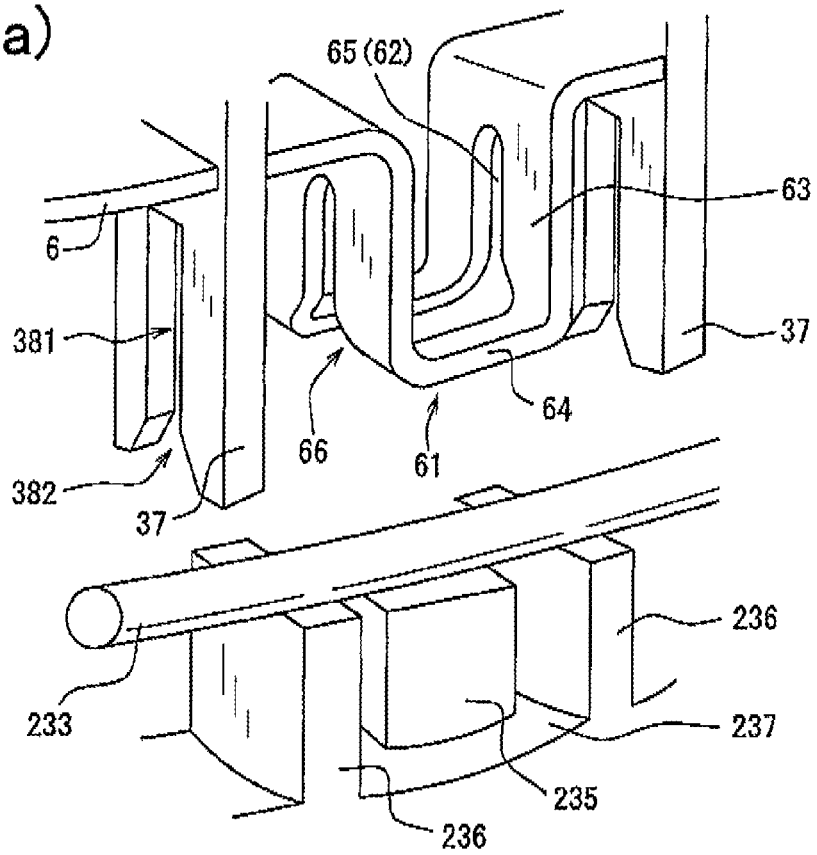
FIG. 6(*a*) is a partial perspective view which illustrates a winding end of a primary winding before being put into a conductor fastener and conductor guides of the ignition coil of FIG. 1.
Figure 6B:
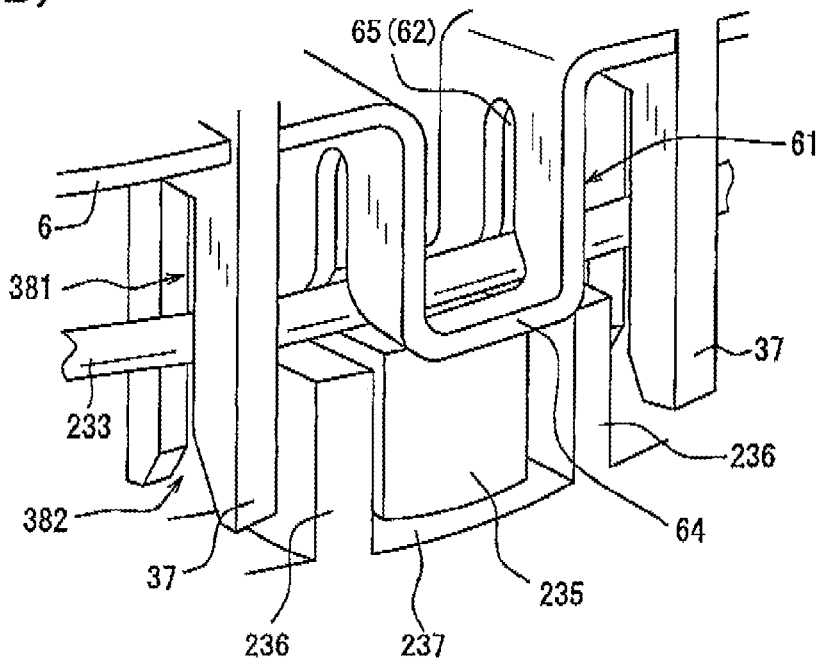

FIG. 6(*a*) illustrates the winding end 233 before being put into the conductor fastener 61 and the conductor guides 37, FIG. 6(*b*) illustrates the winding end 233 which has been inserted into the guide slits 38 of the conductor guides 37, but not yet fitted into the conductor fastener 61 completely.

Before the coil body 2 is fastened into the connector casing 3, each of the winding ends 233 is, as illustrated in FIG. 6(*a*), born by the backup support 234 formed in the recess 237 of the primary spool 231. The winding end 233 is then inserted into the guide slits 38 of the conductor guides 37 as the coil body 2 approaches the connector casing 3. The motion of the winding end 233 is guided by the tapered opening 382 and the main guide slot 381 of each of the conductor guides 37 beneath the conductor fastener 61.

Subsequently, the winding end 233, as illustrated in FIG. 6(*b*), enters the main guide slots 381 of the conductor guides 37 and the gripping slit 62 of the horizontal plate 64 of the conductor fastener 61.

As apparent from FIGS. 6(*a*) and 6(*b*), when the coil body 2 is fastened into the connector casing 3, the winding end 233 is first guided by the tapered openings 382 of the conductor guides 37 into the main guide slots 381. The width of the main guide slots 381 is greater than the diameter of the winding end 233, thus achieving smooth insertion of the winding end 233 into the main guide slots 381. The conductor guides 37 hold the winding end 233 from moving in the radius direction of the coil body 2.

Subsequently, when further inserted into the main guide slots 381 of the conductor guides 37, the winding end 233 enters the gripping slit 62 (the narrow slots 65) of the conductor fastener 61 so that the insulating coating is stripped by the side walls of the narrow slots 65 from the winding end 233, thereby establishing an electric connection of the winding end 233 to the conductor fastener 61, as illustrated in FIG. 5.

The structure of the ignition coil 1 offers the following advantages.

The connector casing 3 is equipped with the conductor guides 37 which extend toward the primary spool 231 and are disposed at both sides of each of the conductor fasteners 61 and face each other in the lengthwise direction of the winding end 233 (i.e., a direction in which the primary winding 232 is wound around the primary spool 231). Each of the conductor guides 37 has the guide slit 38 into which one of the winding ends 233 is inserted when the coil body 2 is fitted into the connector casing 3. The guide slit 38 includes the main guide slot 381 and the tapered opening 382. The main guide slot 381 has the side walls extending substantially parallel to each other. The tapered opening 382 leads to the main guide slot 381 and widens toward the based end of the primary spool 231, thereby facilitating the insertion of the winding end 233 into the main guide slot 381. Before being thrust into the gripping slit 62 of the conductor fastener 61, the winding end 233 is, as described above, inserted into the guide slits 38 of the conductor guides 37.

The connector casing 3 is designed to have installed therein the terminals 6 which arc shaped to have the conductor fasteners 61. Each of the conductor fasteners 61 works as a conductor holder or damper to clamp one of the winding ends 233 of the primary coil 23 tightly and also works as a wire stripper to strip the electric insulation from the winding end 233. The winding ends 233 extend from the turns (i.e., the major body) of the primary coil 23 substantially in a direction in which the primary winding 232 is wound around the primary spool 231, thereby avoiding an undesirable increase in length of the primary spool 231. This permits the size of the ignition coil 1 to be reduced.

The connector casing 3 also has the conductor guides 37 two of which is provided for one of the conductor fasteners 61. Each of the conductor guides 37 has the guide slit 38 into which the winding end 233 is inserted before fitted into the gripping slit 62 of the conductor fastener 61, thereby establishing the alignment of the winding end 233 with the gripping slit 62 of the conductor fastener 61. This facilitates the insertion of the winding end 233 into the gripping slit 62 and the stripping of the electric insulation from the winding end 233, thus ensuring the stability of electric connection between the primary winding 232 and the terminals 6 (i.e., the igniter 32). The established alignment of the winding end 233 with the gripping slit 62 of the conductor fastener 61 also minimizes an excess of load acting on the conductor fastener 61 or the terminal 6 upon the insertion of the winding end 233 into the gripping slit 62 and avoids the deformation of the terminal 6.

The guide slit 38 includes the main guide slot 381 and the tapered opening 382 which widens toward the coil body 2, thereby facilitating the catching of the winding end 233 into the main guide slot 381, which achieves the accurate alignment of the winding end 233 with the narrow slots 65 of the upright plates 63 of the conductor fastener 61.

Each of the conductor fasteners 61 is made up of the upright plates 63 facing each other and the horizontal plate 64. The horizontal plate 64 extends horizontally to connect the ends of the upright plates 63 to make the U-shaped conductor fastener 61. The conductor fastener 61, as described above, has the gripping slit 62 which extends through the longitudinal center lines of the upright plates 63 and the horizontal plate 64. This geometrical structure of the conductor fasteners 61 reduces the mechanical load on the terminals 6 as compared with when the conductor fasteners 61 are formed into a V-shape and results in improved reliability of tight engagement between the terminals 6 and the winding ends 233.

Portions of each of the terminals 6 which extend from the upright plates 63 of the conductor fastener 61 in opposite directions, as can be seen in FIGS. 2 and 5, retained tightly by the conductor guides 37 and the connector casing 3, thereby distributing mechanical load on the conductor fastener 61 to each side of the conductor fastener 61. The tight retention of the conductor fastener 61 by the conductor guides 37 minimizes the deformation of the terminal 6 when the winding end 233 is thrust into the conductor fastener 61 and ensures high reliability of fitting of the winding end 233 into the conductor fastener 61.

The width of the guide slit 38 of each of the conductor guides 37 is greater than that of the gripping slit 62 of the conductor fastener 61. The width of the gripping slit 62 (i.e., the narrow slots 65) is so selected as to establish the tight gripping of the winding ends 233 and also to strip the electric insulation from the winding ends 233. The width, of the guide slit 38 is, as described above, greater than that of the gripping slit 62, thereby minimizing the resistance to insertion of the winding end 233 into the conductor guide 37 to avoid the undesirable deformation of the winding end 233.

The gripping slit 62 of the conductor fastener 61 includes the narrow slots 65 and the tapered slots 66. The narrow slots 65 extend parallel to each other in the upright plates 63. The tapered slots 66 lead to the narrow slots 65, respectively. The tapered slots 66 widen gradually toward the coil body 2, thereby facilitating the insertion of the winding end 233, which has been aligned by the guide slits 38 of the conductor guides 37 with the gripping slit 62 of the conductor fastener 61, into the narrow slots 65. The guide slits 38 of the conductor guides 37 and the gripping slit 62 of the conductor fastener 61 are aligned with the length of the winding end 233, thus ensuring the stability in fitting the winding end 233 into the conductor fastener 61.

Figure 7:
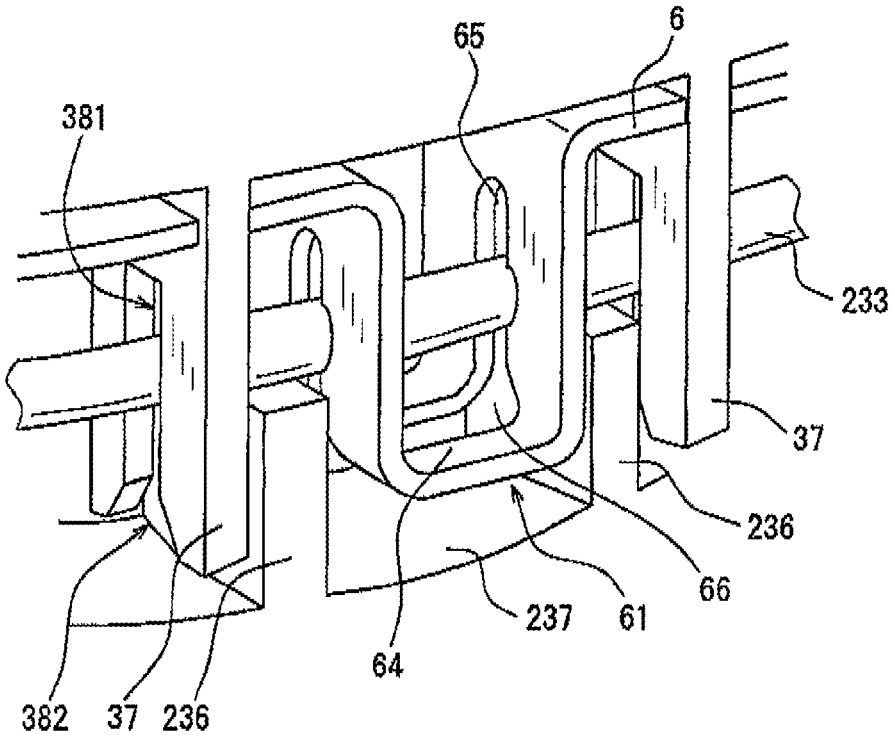
FIG. 7 is a partial perspective view which illustrates structures of a connector casing and a primary spool according to the second embodiment.

FIG. 7 illustrates the structures of the connector casing 3 and the primary spool 231 according to the second embodiment in which the first backup protrusion 235 is omitted.

Specifically, the primary spool 231 does not include the first backup protrusion 235 whose requirements of dimensions in the circumferential and radius directions of the coil body 2 are restrict and is equipped only with the second backup protrusions 236 for supporting the winding end 233 upon insertion thereof into the conductor fastener 61. This results in simplified structure of the primary spool 231. Other arrangements are identical with those of the first embodiment, and explanation thereof in detail will be omitted here.

Figure 8:
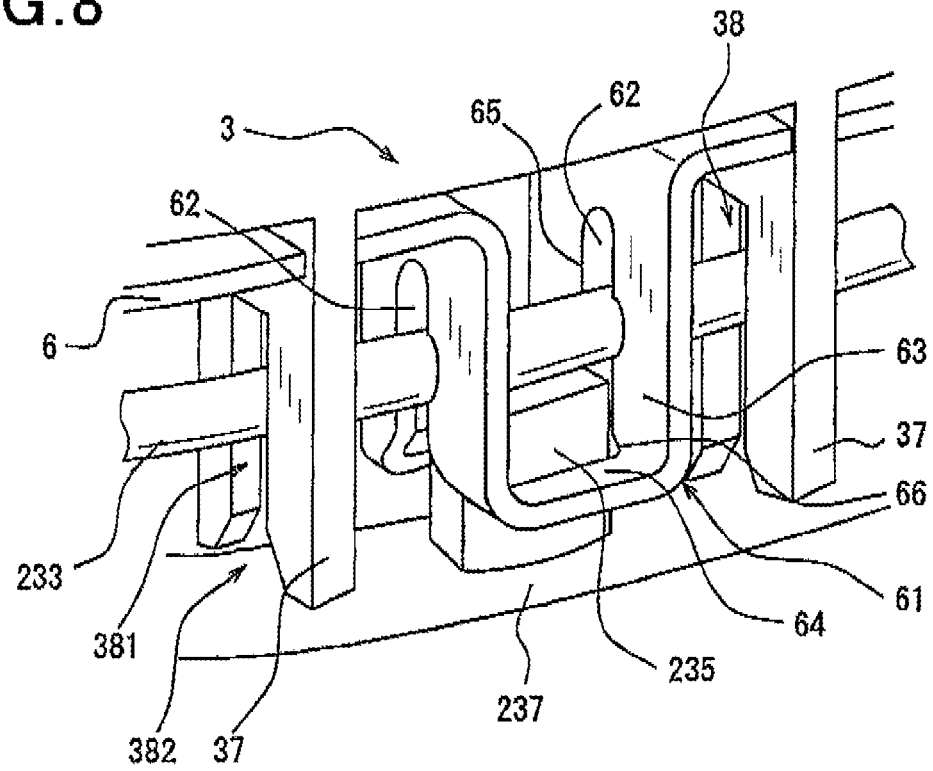
FIG. 8 is a partial perspective view which illustrates structures of a connector casing and a primary spool according to the third embodiment.

FIG. 8 illustrates the structures of the connector casing 3 and the primary spool 231 according to the third embodiment in which the second backup protrusions 236 are omitted.

Specifically, the primary spool 231 does not include the second backup protrusions 236 and is equipped only with the first backup protrusion 235 for supporting the winding end 233 upon insertion thereof into the conductor fastener 61. This results in simplified structure of the primary spool 231. Only either one of the second backup protrusions 236 may be omitted. Other arrangements are identical with those of the first embodiment, and explanation thereof in detail will be omitted here.

Figure 9:
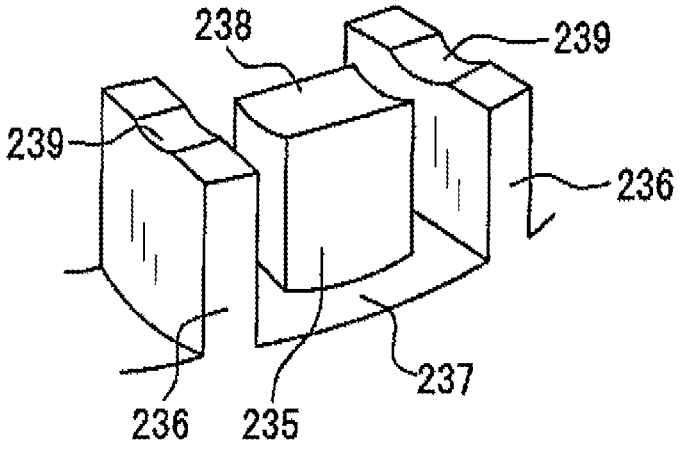
FIG. 9 is a partial perspective view which illustrates structures of a connector casing and a primary spool according to the fourth embodiment.

FIG. 9 illustrates the structure of the primary spool 231 according to the fourth embodiment which is different in structure of the backup supports 234 from the first embodiment.

Specifically, the first backup protrusion 235 has a first support recess 238 formed in an upper surface thereof. Similarly, each of the second backup protrusions 236 has a second support recess 239 formed in an upper surface thereof. Each of the first support recess 238 and the second support recesses 239 are rounded or contoured to conform with the configuration (i.e., the diameter) of the winding end 233. The first support recess 238 and the second support recesses 239 are aligned with, the length of the winding end 233. The first support recess 238 and the second support recesses 239 work as a stopper or holder to hold the winding end 233 from moving in the radius direction of the primary spool 231, in other words, to avoid misalignment of the winding end 233 with the gripping slit 62 of the conductor fastener 61 when the winding end 233 is thrust into the conductor fastener 61.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims,

What is claimed is:

1. An ignition coil for an internal combustion engine comprising:

a coil body which has a base end and a top end farther away from the base end and includes a coil casing, a primary coil, and a secondary coil, the primary coil and the secondary coil being disposed coaxially with each other within the coil casing, the primary coil including a primary spool which is made of resin and around which a primary winding is wound, the primary winding having a winding end which extends from the primary spool substantially in a winding direction that is a direction in which the primary winding is wound; and a connector casing which includes a fitting hole in which the base end of the coil body is fit and a connector for energizing the primary coil, the connector also including a conductive terminal which extends from the fitting hole to the connector and has a conductor fastener disposed inside the fitting hole, the conductor fastener having formed therein a gripping slit which extends in a direction in which the coil body is fitted into the connector casing, wherein the primary spool is equipped with a backup support which protrudes toward the connector casing in a fitting direction that is a direction in which the based end of the coil body is fitted into the connector casing, the backup support working to physically support the winding end, wherein the connector casing also includes conductor guides which extend toward the primary spool in the fitting direction and are disposed away from each other across the conductor fastener in the winding direction, each of the conductor guides having a guide slit into which the winding end is inserted, the guide slit including a main guide slot and a tapered opening, the main guide slot having side wall extending substantially parallel to each other, the tapered opening leading to the main guide slot and having a width tapering away from the coil body in the fitting direction, and wherein each of the conductor guides is so shaped that the winding end is inserted into the guide slit before being thrust into the gripping slit of the conductor fastener when the coil body is fitted into the connector casing.

2. An ignition coil as set forth in claim 1, wherein the conductor fastener is made up of two side plates which face each other and a top plate which connects ends of the side plates which are closer to the coil body, and wherein the gripping slit extends continuously through the top plate into the side plates.

3. An ignition coil as set forth in claim 1, wherein the guide slit of each of the conductor guides has a width greater than that of the gripping slit of the conductor fastener.

4. An ignition coil as set forth in claim 1, wherein the gripping slit includes narrows slots which extend substantially parallel to each other and tapered openings each of which leads to one of the narrow slots, each of the tapered openings having a width widening toward the coil body.

5. An ignition coil as set forth in claim 1, wherein the backup support has formed in a surface thereof a recess which supports the winding end in contact therewith.

6. An ignition coil as set forth in claim 1, wherein each of the conductor guides serves to establish alignment of the winding end with the gripping slit of the conductor fastener when the winding end is thrust into the gripping slit and then gripped in the conductor fastener to make an electric connection of the winding end and the conductive terminal.

* * * * *